US006994159B2

(12) United States Patent
Wendland

(10) Patent No.: US 6,994,159 B2
(45) Date of Patent: Feb. 7, 2006

(54) SYSTEM FOR EXTRACTING NATURAL GAS HYDRATE

(76) Inventor: Charles Wendland, 1605 Whipple Rd., Hayward, CA (US) 94544

( * ) Notice: Subject to any disclaimer, the term of this patent is extended or adjusted under 35 U.S.C. 154(b) by 0 days.

(21) Appl. No.: 10/817,866

(22) Filed: Apr. 6, 2004

(65) Prior Publication Data

US 2005/0092482 A1 May 5, 2005

Related U.S. Application Data

(60) Provisional application No. 60/517,245, filed on Nov. 4, 2003.

(51) Int. Cl.
*E21B 43/24* (2006.01)

(52) U.S. Cl. ..... 166/57; 299/8

(58) Field of Classification Search ..... 166/272.1, 166/302, 303, 57; 299/8
See application file for complete search history.

(56) References Cited

U.S. PATENT DOCUMENTS 4,424,858 A * 1/1984 Elliott et al. ..... 166/302
5,950,732 A * 9/1999 Agee et al. ..... 166/302
6,299,256 B1 * 10/2001 Wyatt ..... 299/8

* cited by examiner

*Primary Examiner*—David Bagnell
*Assistant Examiner*—Matthew J. Smith
(74) *Attorney, Agent, or Firm*—Theodore J. Bielen, Jr.

(57) ABSTRACT

A system for extracting natural gas from natural gas hydrates utilizing a first conduit positioned in the natural gas hydrate containing strata. A flowable heat containing medium is urged through the first conduit and contacts the natural gas hydrate in the strata. The natural gas vapor produced is directed through a second conduit to a collector located adjacent the exit of the second conduit the natural gas is directed to storage or use facilities.

16 Claims, 2 Drawing Sheets

SYSTEM FOR EXTRACTING NATURAL GAS HYDRATE

CROSS-REFERENCES TO RELATED APPLICATIONS

The present application is a non-provisional application based on provisional application Ser. No. 60/517,245 filed 4 Nov. 2003.

BACKGROUND OF THE INVENTION

The present invention relates to a novel and useful system for recovering natural gas from natural gas hydrates.

Natural gas hydrates are chemical compounds composed of natural gas, such as methane and water and a crystalline ice-like form. Natural gas hydrates form at temperatures below the freezing point of water and are normally found in strata or sediment beneath a body of water such as a river, lake, or sea bed.

Although quite common in occurrence, natural gas hydrates have not been subject of activity to recover the natural gas components, e.g. methane, propane, butane, and the like, for use as an energy source. It is also believed that natural gas hydrates are quite common and plentiful.

A system for extracting natural gas from natural gas hydrates would be a notable advance in the energy field.

BRIEF SUMMARY OF THE INVENTION

In accordance with the present invention a novel and useful system for extracting natural from natural gas hydrates is herein provided.

The system of the present invention utilizes a first conduit having an entrance and an exit. The exit of the first conduit is positioned in the natural gas hydrate containing strata which is usually found beneath a body of water such as the ocean, a lake, a river, and the like. The exit of the first conduit may be burrowed into the sediment or strata layer containing the natural gas hydrates but terminus of the first conduit may take the form of a simple opening or a sparger type terminal, which extends the exit of the first conduit over a larger area.

In this regard, a flowable heat containing medium such as steam is urged by any suitable means to direct the flowable heat containing medium through the entrance of the first conduit and into the natural gas hydrate containing strata. Such medium is provided in sufficient quantities to convert the natural gas hydrate crystals into natural gas vapor. A sparger exit of the first conduit may easily spread the heat containing medium over a particular area of the strata containing the natural gas hydrate crystals. Pumps and valves may aid in this endeavor to accurately control the quantity and rate of flow of the heat contained medium through the first conduit. It should be noted that a plurality of first conduits may be used where a particularly large deposit of natural gas hydrates exist. In additional heat may be delivered to the natural gas strata by other methods e.g. via electrical resistance heating.

The application of heat to the natural gas hydrate crystals produces a gas which rises to the surface of the bed beneath eh body of water. A collector is employed to gather the natural gas vapor and lead the same to the surface of the body of water. The collector may take many shapes, such as a funnel-like element. In any case, the collector would be anchored in some manner to the surface of the bed to prevent movement and to ensure that the natural vapor gas emanating from the strata does not escape the confines of the collector.

To aid in the movement of the natural gas from the strata to the collector, a second conduit may be employed such that the entrance of the same lies in the natural gas strata and the exit extends into the collector anchored to the surface of the bed.

In addition, heat may be employed to the interior of the collector to prevent recrystalization of the natural gas into its hydrate form. A monitor may be employed to ascertain the level of water within the collector and to adjust the same by valving the escape of natural gas through the top of the collector to the surface. Water can enter or leave the interior of the collector through vents which do not interfere with the exits of the second conduit directing the natural gas from the strata to the collector. After exiting the collector, the natural gas may be used, transported, stored, and the like.

After recovery of natural gas from crystalline natural gas hydrates of a certain area, the collector may be moved laterally along the bed of the body of water and restarted the collection process. Also, new first and second conduits may be provided. Alternatively the first and second conduits may be repositioned concomitant with the moving of the collector itself.

It may be apparent that a novel and useful system for extracting natural gas from natural gas hydrates has been heretofore described.

It is therefore an object of the present invention to provide a system for extracting natural gas from natural gas hydrates having components which are practical and simple to manufacture, install, and operate.

Another object of the present invention is to provide a system for extracting natural gas hydrates which is suitable for operation beneath a body of water and atop a bed beneath the body of water.

Another object of the present invention is to provide a system for extracting natural gas from natural gas hydrates which is safe to operate in areas adjacent land masses.

Yet another object of the present invention is to provide a system for extracting natural gas from natural gas hydrates which is easily moved from one area to another area along the bed beneath the body of water.

The invention possesses other objects and advantages especially as concerns particular characteristics and features thereof which will become apparent as the specification continues.

Figure 1:
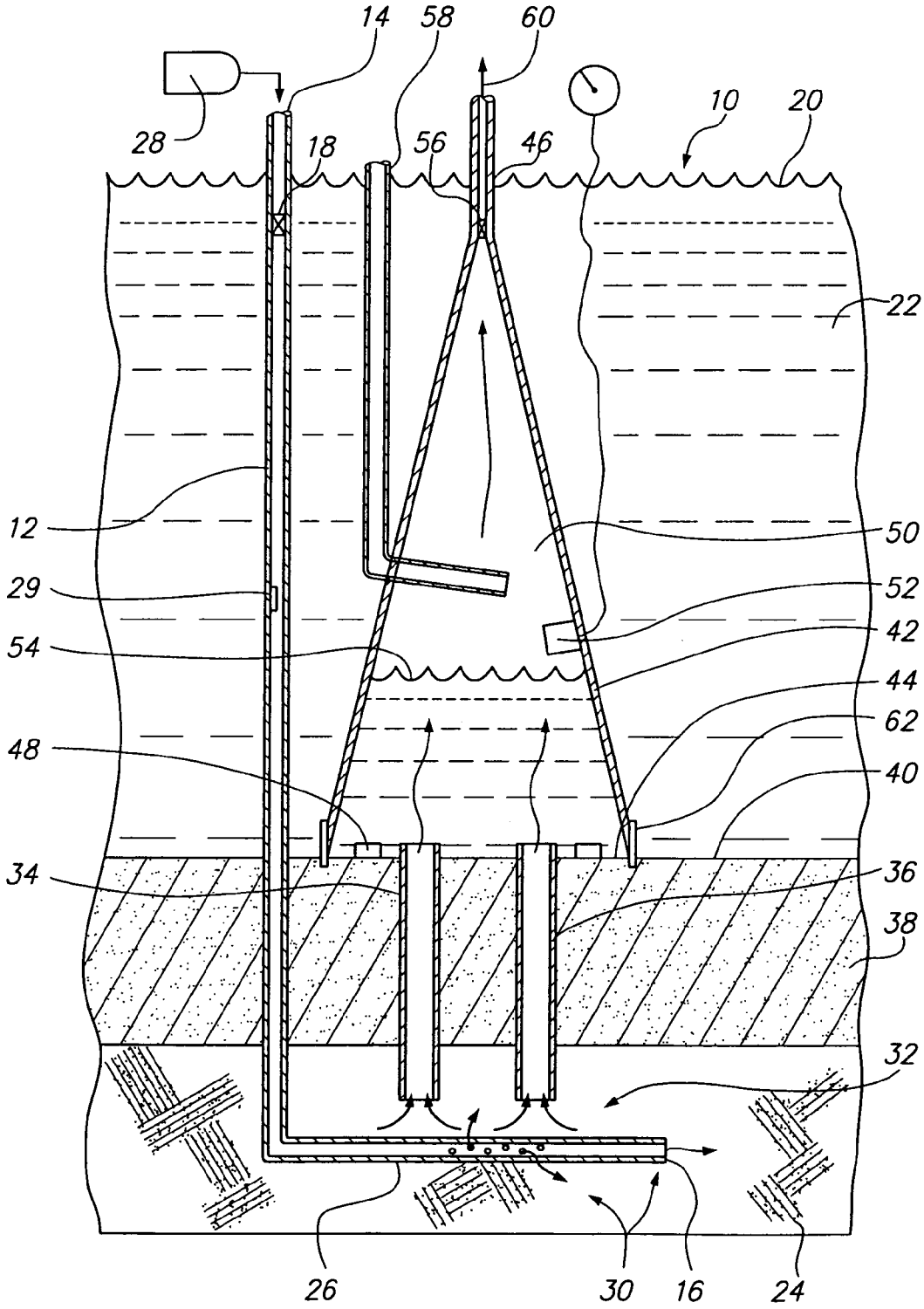
FIG. 1 is a sectional view of the system of the present invention in operation beneath a body of water having a bed.

For a better understanding of the invention reference is made to the following detailed description of the preferred embodiments thereof which should be referenced to the prior described drawings.

DETAILED DESCRIPTION OF THE PREFERRED EMBODIMENTS OF THE INVENTION

Various aspects of the present invention will evolve from the following detailed description of the preferred embodiments thereof which should be taken in conjunction with the prior delineated drawings.

A preferred embodiment of the invention is shown in the drawings by reference character 10. System 10 includes a first conduit 12 having an entrance 14 and an exit 16. Valve 18 regulates the flow of heat containing medium such as steam, heated water, heated gases, and the like from above the surface of body of water 22 to strata 24 which contains crystalline natural gas hydrates. Natural gas hydrates are a crystalline material which includes natural gas components, such as methane, propane, butane, and the like, combined with water and certain other chemical components such as hydrogen sulfide and the like. Exit 16 of first conduit 12 may take the form of a sparger 26 which tends to spread the heat emanating from entrance 14 of first conduit 12 over a lateral area within strata 24. Pump 28 may aid in this endeavor. Temperature monitor 29 aids in the regulation of heat containing flowable material from pump 28. Directional arrows 30 represent the flowable heat containing medium such as a liquid or gas. Pump 28 or a like item urges flowable heat containing medium through conduit 12 in sufficient quantities to release the natural gas from the natural gas hydrates located in strata 24. Directional arrows 32 represent the flow of natural gas from strata 24.

Natural gas in vapor form leaving strata 24 travels to second conduits 34 and 36. Conduits 34 and 36 have been placed through overburden layer 38 above strata 24 in order to communicate with strata 24 in a place above bed 40 marking the meeting of water body 22 and the mass below bed 40. Although two second conduits 34, 36 are depicted in FIG. 1, it may be apparent that a large number of second conduits may be used in a similar manner.

A collector 42 is also employed in the present invention. Collector 42 is shown as being funnel-shaped and includes a mouth 44 and a narrower exit 46 which lies above the surface 20 of water body 22. Collector 42 may be insulated. Vents such as vent 48 body of water 22 to enter the internal chamber 50 of collector 42. A monitor 52 detects the level 54 of water within chamber 50 of collector 42. Such level 54 may be adjusted by valve 56 which would regulate the pressure of natural gas within chamber 50.

To prevent recrystalization of the natural gas hydrates emanating from layer 24 within chamber 50 of collector 42, a heat source 58 may be employed. The medium for heating may be a flowable material, an electrical resistance heating system, and the like. Natural gas exiting exit 46 of collector 42, directional arrow 60 may be used, transported, stored, or employed in any manner desired. A typical anchor 62 would hold collector to bed 40 as shown in FIG. 1, while natural gas is being collected.

Figure 2:
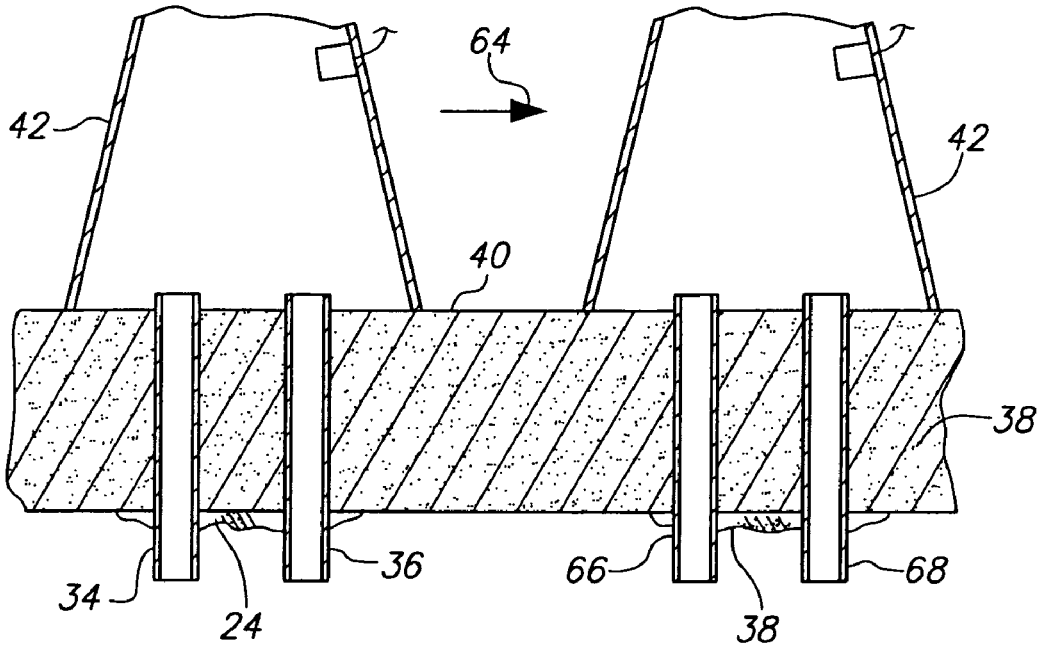
FIG. 2 represents the ability of the collector of the present invention laterally across the bed beneath the body of the water depicted in FIG. 1.

Turning to FIG. 2, it may be observed that collector 42, is movable along bed 40 as typical anchor or anchors 62 are removed, directional arrow 64. In such a case, new second conduits 66 and 68 may be used when collector 42 is repositioned as shown in FIG. 2. A new first conduit may also be employed (not shown) in the same manner depicted in FIG. 1 to apply heat to the natural gas hydrate located in strata 24. Thus, the system of the present invention allows for recovery of natural gas from strata 24 by the reemployment of the elements of system 10 depicted in FIGS. 1 and 2.

Figure 3:
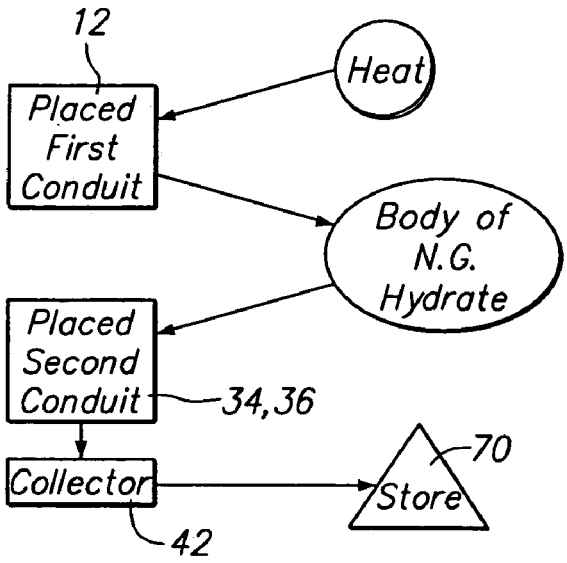
FIG. 3 is a block diagram illustrating the operation of the system of the present invention.

In operation, with reference to FIGS. 1–3, heat is directed to strata 24 through first conduit 12 and directed to a narrow portion of strata 24 through exit 16 or over a wider area through sparger 26. The body of natural gas hydrate within strata 24 is vaporized and caused to waft upwardly through second conduit 34 or 36. From there the natural gas passes into collector 42 which directs the natural gas into a facility which employs or transports the same or into a storage facility 70 depicted in FIG. 3.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A system for extracting natural gas from natural gas hydrate matter located in natural gas bearing strata beneath a bed of a body of water;

comprising:

a. a first conduit including an entrance and an exit, said exit positioned in the natural gas hydrate containing strata beneath the bed;

b. a flowable heat containing medium;

c. means for urging said flowable heat containing medium through said entrance of said first conduit and out from said exit thereof to the natural gas hydrate containing strata in sufficient quantity to convert the natural gas hydrate into natural gas vapor;

d. a second conduit having an entrance and an exit said second conduit leading the natural gas vapor from beneath the bed, into said entrance and out from said exit of said second conduit to a place above the bed;

e. a collector having a mouth, an exit and an intermediate portion between said mouth and exit, said collector located adjacent said exit of said second conduit to gather natural gas vapor passing out from said exit of said second conduit the natural gas vapor entering said mouth of said collector, traveling through said intermediate portion of said collector, and egressing from said exit of said collector; and f. a monitor for detecting the level of water within said collector.

2. The system of claim 1 which further comprises means for storing the natural gas vapor egressing from said exit of said collector.

3. The system of claim 1 in which said collector further includes a vent for water displaced by the natural gas vapor within the collector.

4. The system of claim 1 in which said first conduit further includes a sparger serving as said exit thereof.

5. The system of claim 1 which additionally comprises a valve to regulate the movement of said flowable heat containing medium through said first conduit.

6. The system of claim 1 which additionally comprises a valve to regulate the flow of natural gas vapor through said collector.

7. The system of claim 1 which further comprises means for insulating said collector.

8. The system of claim 1 which additionally comprises an anchor for holding said mouth of said collector in a position relative to the bed.

9. A system for extracting natural gas from natural gas hydrate matter located in natural gas bearing strata beneath a bed of a body of water;

comprising:

a. a first conduit including an entrance and an exit, said exit positioned in the natural gas hydrate containing strata beneath the bed;

b. a flowable heat containing medium;

c. means for urging said flowable heat containing medium through said entrance of said first conduit and out from said exit thereof to the natural gas hydrate containing strata in sufficient quantity to convert the natural gas hydrate into natural gas vapor;

d. a second conduit having an entrance and an exit said second conduit leading the natural gas vapor from beneath the bed, into said entrance and out from said exit of said second conduit to a place above the bed;

e. a collector having a mouth, an exit and an intermediate portion between said mouth and exit, said collector located adjacent said exit of said second conduit to gather natural gas vapor passing out from said exit of said second conduit the natural gas vapor entering said mouth of said collector, traveling through said intermediate portion of said collector, and egressing from said exit of said collector; and f. a temperature monitor detecting the temperature in said first conduit.

10. The system of claim 9 which further comprises means for storing the natural gas vapor egressing from said exit of said collector.

11. The system of claim 10 in which said first conduit further includes a sparger serving as said exit thereof.

12. The system of claim 10 which additionally comprises a valve to regulate the movement of said flowable heat containing medium through said first conduit.

13. The system of claim 10 which additionally comprises a valve to regulate the flow of natural gas vapor through said collector.

14. The system of claim 10 which further comprises means for insulating said collector.

15. The system of claim 10 which additionally comprises an anchor for holding said mouth of said collector in a position relative to the bed.

16. The system of claim 9 in which said collector further includes a vent for water displaced by the natural gas vapor within the collector.

* * * * *